US005888005A

United States Patent [19]

Gueret

[11] Patent Number: 5,888,005

[45] **Date of Patent: *Mar. 30, 1999**

[54] CAPILLARY DOSING UNIT WITH TERMINAL SLIT

[75] Inventor: Jean-Louis Gueret, Paris, France

[73] Assignee: L'oreal, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 603,654

[22] Filed: Feb. 16, 1996

[30] Foreign Application Priority Data

Feb. 16, 1995 [FR] France ..... 95-01788

[51] Int. Cl.[6] ..... A45D 34/00; A45D 40/00

[52] U.S. Cl. ..... 401/128; 401/119; 401/126; 401/130

[58] Field of Search ..... 401/119, 128, 401/130, 267, 256, 126

[56] References Cited

U.S. PATENT DOCUMENTS

| | | | |
|---|---|---|---|
| 143,347 | 9/1873 | Holman | 401/267 |
| 371,133 | 10/1887 | Fisher | 401/267 X |
| 1,909,096 | 5/1933 | Cooney . | |
| 1,915,599 | 6/1933 | Ellison . | |
| 1,921,248 | 8/1933 | Carpenter | 401/130 |
| 1,966,581 | 7/1934 | Conner | 401/128 |
| 2,290,576 | 7/1942 | Scioscia | 401/119 |
| 2,296,139 | 9/1942 | Blair . | |
| 2,427,228 | 9/1947 | Palmer | 401/119 |
| 2,527,832 | 10/1950 | McClure | 401/267 |
| 2,561,252 | 7/1951 | Waring | 401/119 |
| 2,681,463 | 6/1954 | Gordon . | |
| 2,736,050 | 2/1956 | Lee | 401/128 X |
| 2,990,563 | 7/1961 | Davidson . | |
| 3,130,735 | 4/1964 | Clark | 401/128 |
| 3,536,411 | 10/1970 | Eisert . | |
| 4,850,727 | 7/1989 | Gueret | 401/130 X |
| 4,974,980 | 12/1990 | Gueret | 401/119 |
| 5,123,431 | 6/1992 | Wilson | 401/119 X |

FOREIGN PATENT DOCUMENTS

| | | | |
|---|---|---|---|
| 1174544 | 3/1959 | France . | |
| 1420452 | 11/1965 | France . | |
| 2412287 | 7/1979 | France . | |
| 463388 | 7/1928 | Germany | 401/256 |
| 564511 | 6/1957 | Italy | 401/119 |
| 1073553 | 6/1967 | United Kingdom | 401/119 |
| 1318677 | 5/1973 | United Kingdom . | |
| 2178647 | 2/1987 | United Kingdom . | |

*Primary Examiner*—Steven A. Bratlie
*Attorney, Agent, or Firm*—Oblon, Spivak, McClelland, Maier & Neustadt, P.C.

[57] ABSTRACT

A capillary dosing unit includes a stem provided with an axis of symmetry, a grip at a first end of the stem and at least one slit at a second end of the stem which emerges along the axis of the stem. This dosing unit allows accurate dosing of a liquid such as a nailcare oil.

20 Claims, 3 Drawing Sheets

CAPILLARY DOSING UNIT WITH TERMINAL SLIT

BACKGROUND OF THE INVENTION

1. Field of the Invention

The present invention relates to a capillary dosing unit for the local application of a precise quantity of an aqueous or oily liquid intended in particular for the cosmetic or dermopharmaceutical care of the nails, eyelids or other parts of the face or scalp.

2. Discussion of the Background

Related applicators in the field of cosmetics for delivering a liquid product, in particular to the eyelids, consist of a foam, a felt pad or a flocked adaptor provided with a large quantity of small fibers. These types of applicators preclude the delivery of a very small quantity of product and in particular of a precise dose of nailcare product, sufficient to be spread around the whole nail, to the edge of the nail and of the skin without it being necessary to wipe the nail to remove the excess. Furthermore, the felt pad and the foam release the product too slowly. Hitherto, none of the related applicators (see in particular those of the documents FR-A-2 505 150, FR-A-2 633 256) allows the delivery of exactly the required dose of care liquid at a suitable rate. Furthermore, the quantities delivered to the nail or the skin vary from one application to another. This is due in particular to the fact that these related applicators do not include a system for the automatic wiping of the surplus product.

A related applicator is also disclosed in U.S. Pat. No. 2 990 563 and GB-A-1 318 677, which comprises a stem furnished at a first end with a gripping member and at a second end with two slits of rounded shape. This rounded end allows only point contact with the surface of the skin or of the nail, thus requiring the application of the liquid to be repeated several times in order to treat the whole of the relevant region. Furthermore, with the rounded end of the stem it is difficult to spread the product over the area to be treated. Moreover, the contact area of a rounded end cannot be altered. Indeed, whatever the inclination of the applicator, the contact area is always the same and cannot be modified according to the area to be treated, especially according to the relief or shape of the area.

There is therefore still a need for a dosing applicator capable of delivering a small constant dose of liquid product, in particular to the nails or to localized lesions on the skin or scalp which enables the product to be spread easily and which can be used for various shapes of surfaces to be treated while also restricting the number of applications.

SUMMARY OF THE INVENTION

For this purpose, an object of the present invention is to provide for a novel capillary dosing applicator which comprises a stem provided with an axis of symmetry, a grip at a first end and at a second end at least one slit emerging along the axis of the stem, characterized in that at least one part of the second end of the stem comprising the slit includes an inclined surface along the axis of the stem. The axis of symmetry can be provided solely over part of the stem. The stem can be bent and in this case the axis of symmetry is understood to mean the axis of the part of the stem which includes the slit end. The stem can also be curved, and in this case the axis of the stem corresponds to the curved median line of the stem.

The presence of an inclined surface in the second end of the stem enables the applicator to be used with different contact areas. In particular the product can be applied more quickly while restricting the number of applications. Thus, in the case of nail treatment, in a single application a deposition of product bordering the cuticle can be obtained.

Employing a terminal slit makes it possible to fill the applicator, which thus serves as product reserve, always to the same level and hence always to deliver the same dose from one application to another. Furthermore, the dose is delivered only when the slit end is applied to the surface of the nail or skin to be cared for or treated.

The dose to be delivered depends on the viscosity of the product to be delivered and on the dimensions of the slit. Thus, by altering its width, depth and length, it is possible to deliver exactly the required dose of product depending on its viscosity.

According to the invention the stem can include a terminal slit emerging along the axis of the stem, or several slits one of which emerges along the axis and the others of which emerge along an axis parallel to the axis of symmetry of the stem. Furthermore, the slit or slits can have various shapes and in particular:- the shape of a U or of a segment in a plane passing through the axis of symmetry, or the shape of a cross in a plane perpendicular to the axis of symmetry. Furthermore the lengths of the slits, measured along the axis of the stem, secant or otherwise, may be the same or different. Moreover, the stem can be cylindrical, or parallelepipedal, or have an oval or polygonal cross-section.

According to the invention, the second end of the stem can be cut on a slant and can also be rounded or better still have the shape of a cloven hoof.

According to a preferred variant of the invention, the slit can cut the inclined surface at least in part and preferably at its middle.

Furthermore, the stem can be hollow and in this case serve as product reservoir until the slit end is applied to the nail.

Moreover, the stem can be off-centered with respect to an axis of the gripping member.

So as to deliver the product gently, the dosing unit of the invention can include a damping system between the stem and the grip. This system can include a spring or any other system which is elastically deformable in the axial direction (for example a foam). It may furthermore include a flexible stem, for example a stem made from a flexible material, like an elastomer, such as, for example from an elastomer chosen from the group of elastomers of polyethylene, of polyurethane, of polyester; polyether-block-amides; polyvinyls; terpolymers of ethylene, propylene and a diene (EPDM); styrene-butadiene block copolymers (SEBS-SIS), silicones, nitrile or natural rubbers, etc., or a stem including a region of smaller cross-section.

According to the invention, the stem can be made from one and the same material or else include at its second slit end a material differing from the remainder of the stem. This or these materials may be molded, overmolded or attached adhesively or by heat-welding. The stem can be made from one or more heat-setting thermoplastic or elastomeric materials, or even from metal or glass. In particular, the end material can be a cellular flexible material, such as a foam.

The capillary dosing unit can be used to dispense a local dose of product in particular around a nail, over an eyelid or over a pimple, blackhead, wart or over a cutaneous lesion.

A further object of the invention is also to provide for a novel care or make-up assembly, in particular for the nails, including a container provided with a neck and containing a liquid care or make-up product, a cap which is able to close the container at neck level, and a dosing applicator such as defined above.

Accordingly, the present invention relates to a capillary dosing applicator which comprises a stem provided with an axis of symmetry; a grip provided at a first end of the stem; and at least one slit provided at a second end of the stem which emerges along the axis of the stem. At least one part of the second end of the stem which comprises the slit includes an inclined surface along the axis of the stem.

The present invention also relates to a care or make-up assembly which comprises a container provided with a neck and containing a liquid care or make-up product; a grip which is capable of closing the container; and a dosing applicator which comprises a stem provided with an axis of symmetry integral with the grip via a first end and having at least one slit at a second end. The at least one slit emerges along the axis of the stem.

The present invention also relates to a care or make-up assembly which comprises a container provided with a neck and containing a liquid care or make-up product; a grip which is capable of closing the container; and a dosing applicator which comprises a stem provided with an axis of symmetry integral with the grip via a first end and having at least one slit at a second end which emerges along the axis of the stem. At least one part of the second end of the stem which comprises the slit includes an inclined rim along the axis.

The present invention also provides for a nail care or make-up assembly which comprises a container provided with a neck and containing a liquid nail care or make-up product; a grip which is capable of closing the container; and a dosing applicator which comprises a stem provided with an axis of symmetry integral with the grip via a first end and having at least one slit at a second end which emerges along the axis of the stem. At least one part of the second end of the stem which comprises the slit includes an inclined rim along the axis.

BRIEF DESCRIPTION OF THE DRAWINGS

In describing the preferred embodiments of the present invention illustrated in the drawings specified terminology is employed for the sake of clarity. However, the invention is not intended to be limited to the specific terminology so selected, and it is to be understood that each specific element includes equivalents which operate for a similar purpose.

A more complete appreciation of the invention and many of the attendant advantages thereof will be readily obtained as the same becomes better understood by reference to the following detailed description, particularly when considered in connection with the accompanying drawings, wherein:

FIGS. 8*a*–8*b* illustrate a further embodiment of the wiping element of the capillary dosing unit of the present invention.

DESCRIPTION OF THE PREFERRED EMBODIMENTS

Figure 1:
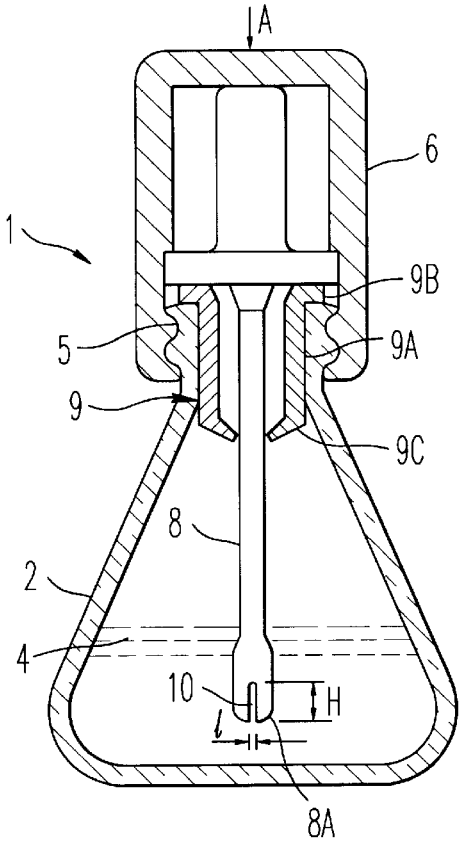
FIG. 1 schematically represents a nailcare assembly according to the invention.
Figure 1A:
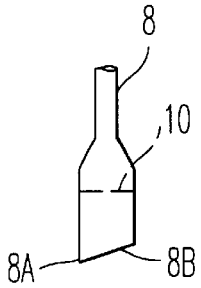
FIG. 1*a* is a profile view of the capillary dosing unit of FIG. 1.

Referring now to the drawings, wherein like reference numerals designate identical or corresponding parts throughout the several views, and more particularly to FIG. 1 thereof, represented in FIG. 1 is a nailcare assembly, denoted overall by the reference numeral 1, including a container 2 holding a care oil 4 and furnished with a neck 5 onto which may be screwed or snap-fitted a cap 6 serving as a member for gripping the product. According to the invention the cap 6 forms part of a capillary dosing applicator including a solid stem 8, provided at its end 8*a* opposite the cap 6 with a capillary slit 10 emerging along the axis of symmetry A of the stem 8. The slit end is here cut on a slant (or bevel) and has the shape of a cloven hoof as seen better in FIG. 1*a*; this end has an inclined surface 8*b* which is cut at its middle by the slit 10. The height H of the slit 10, measured along the axis A, is around 1 mm to 20 mm. Its width 1 is fixed depending on the viscosity of the oil; the width can vary from 0.2 mm to 2.5 mm for an oil viscosity ranging from around 100 mPa·s to 600 mPa·s, whereas the thickness of the stem 8 is around 3.5 mm, in order to deliver a micro-dose of around 1 $\mu$l to 350 $\mu$l of product. Here, the stem is made from a single material, in particular by molding low density polyethylene.

The shape and volume of the slit make it possible to take up only the necessary quantity of product to be delivered and to always load only the slit with the same quantity of product. Any excess product taken up is removed by passing the stem, before application, through a circular wiping element 9 fixed to the neck 5 of the container. The element 9 takes the shape of a glove finger comprising a cylindrical skirt 9*a* bearing against the internal wall of the neck 5; this skirt 9*a* is integral with a washer 9*b* resting on the neck 5. This washer 9*b* acts as a seal between the neck 5 and the cap 6, in the storage position of the assembly. On the side facing the container 2, the skirt 9*a* is furnished with an annular and flexible wiping lip 9*c* defining an opening slightly smaller than the cross-section of the stem 8.

This assembly is used as follows: after unscrewing the cap 6, the user withdraws the applicator loaded with product through the wiping element 9; this operation eliminates any surplus product from the stem 8; by placing the end 8*a* and the inclined surface 8*b* on the site of application, for example on the cuticle of a nail, the capillarity initially retaining the product in the slit is broken, thus liberating the entire dose of product in one go. The inclined surface 8*b* in contact with the nail enables the product to be deposited over a considerable area, rather than over a point region, and then enables the product to be spread easily over the surface of the nail. Moreover, the cloven hoof shape of the applicator makes it possible to push back the cuticle so as to enlarge the area of the nail and to ease the subsequent making-up thereof, while treating the nail with the product applied.

Figure 2:
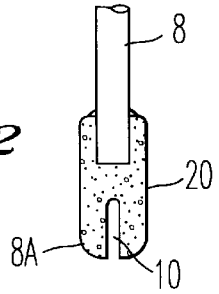
FIGS. 2–6 illustrate various shapes and embodiments of the stem of the capillary dosing unit of the present invention.

In FIG. 2 the slit end 8*a* of the stem 8 is made from a material differing from that of the stem 8 and in particular from a cellular foam 20 which is compatible with the product, for example a polyethylene foam. The slit foam 20 is fixed to the end 8*a* of the stem in particular by heat-welding.

Figure 3:
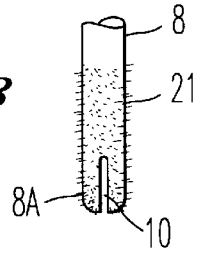

The stem 8 represented in FIG. 3 differs from that of FIG. 1 solely through the presence of a flocking 21, especially made from polyamide fibers, on the end 8*a* of the stem 8.

Figure 4:
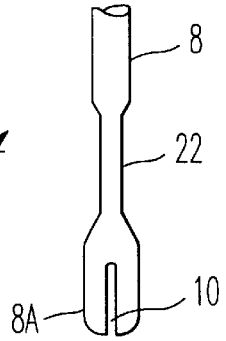

The stem 8 of FIG. 4 differs from that of FIG. 1 through the presence of a region 22 of smaller diameter than that of the remainder of the stem, so as to make the stem more supple and hence more flexible during application. For a cylindrical stem with an external diameter of 3.5 mm, the region of smaller diameter may range from around 0.5 mm to 1.5 mm.

Figure 5:
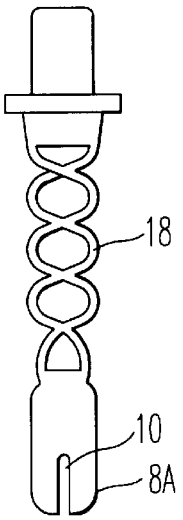

The stem 8 of FIG. 5 is provided with a flexible helical spring 18 which can be made from the same material as the end 8*a* or from a different material. This arrangement means that the applicator applies the product gently in the axial direction and in the radial direction.

Figure 6:
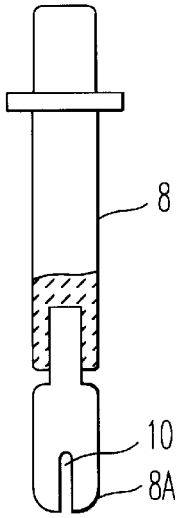

The stem 8 shown in FIG. 6 differs from that of FIG. 2 solely through the fact that the end 8*a* is made from a flexible material, for example from silicone rubber. It can be fixed to the tip of the stem adhesively and/or by a plug-in fit.

Figure 7A:
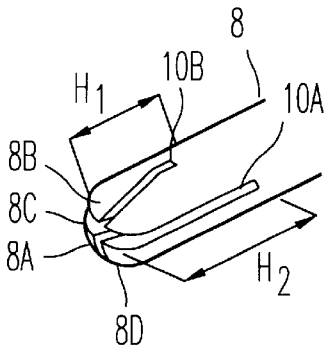
FIGS. 7*a*–7*d* illustrate different embodiments of the slit in the stem of the capillary dosing unit of the present invention.
Figure 7B:
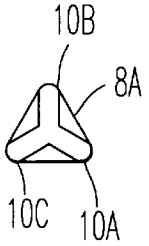
Figure 7C:
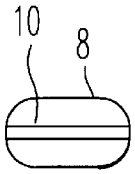

FIGS. 7*a* to 7*d* show different embodiments of the slit. Thus, FIG. 7*a* shows two crossed slits 10*a*, 10*b* forming an angle of 90°. The heights $H_1$, $H_2$ of the slits 10*a*, 10*b* are different. A first half 8*c* of the stem 8 includes the inclined surface 8*b*, whereas the second half 8*d* of the stem 8 has a rounded end. In FIG. 7*b*, the end 8*a* includes three slits 10*a*, 10*b*, 10*c* laid out in a star shape. Furthermore, the stem has a triangular cross-section. According to FIG. 7*c*, the stem 8 has an oval cross-section; the slit 10 extends along the major axis of the oval. The inclined surfaces 8*b* of the stem 8 are visible in this Figure. The stem 8 of FIG. 7*d* has a square cross-section with rounded corners; two slits 10*a*, 10*b* are arranged along the diagonals of the square.

Figure 8A:
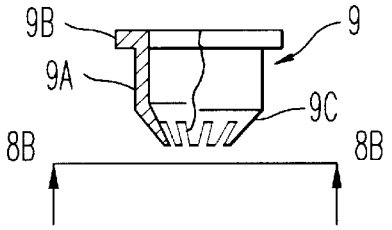
Figure 7D:
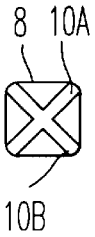
Figure 8A:
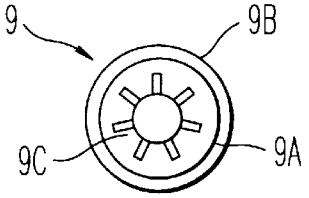

The wiping element 9 represented in FIGS. 8*a* and 8*b* differs from that of FIG. 1 through the fact that the wiping lip 9*c* is indented. As may be seen in the partial section in FIG. 8*a*, the lip 9*c* is notched. FIG. 8*b* is a view along the direction VIIIb—VIIIb of FIG. 8*a*.

Figure 9:
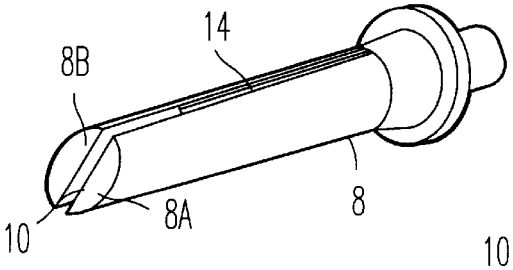
FIGS. 9–12 illustrate further embodiments of the stem of the capillary dosing unit of the present invention.

The stem 8 represented in FIG. 9 differs from that of FIG. 1 through the presence of three longitudinal capillary grooves 14, parallel to the axis of the stem 8, prolonging the slit 10 over the stem towards the cap. These grooves 14 serve as a micro-reservoir for the product taken up. Furthermore, the end 8*a* of the stem 8 is cut on a slant, in a manner similar to the embodiment of FIG. 1.

Figure 10:
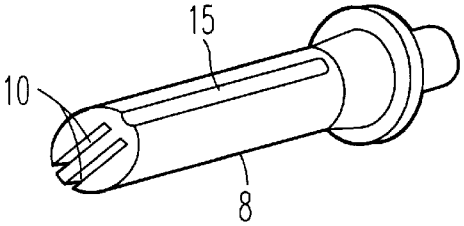

The stem 8 represented in FIG. 10 differs from that of FIG. 9 through the presence of two slits 10 parallel to the axis of the stem 8. The grooves 14 of the stem of FIG. 9 have here been substituted with a channel 15 of semicircular cross-section; this channel 15 also serves as a micro-reservoir for the product taken up. The end 8*a* of the stem 8 is cut on a slant, in a manner similar to the embodiment of FIG. 1.

Figure 11:
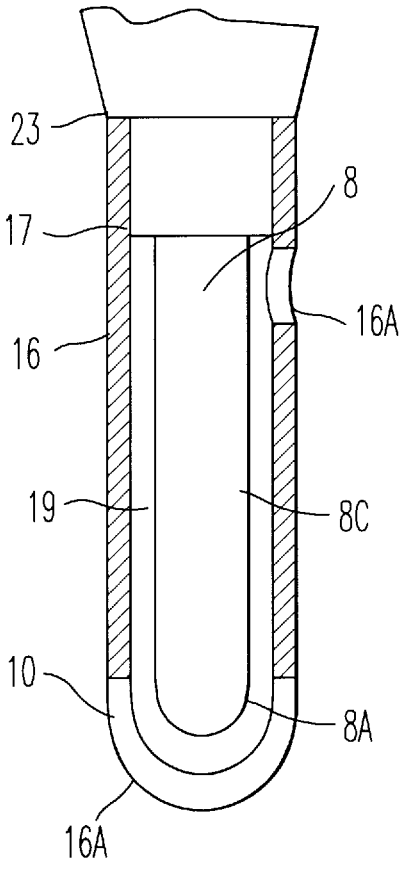

The stem 8 shown in FIG. 11 includes a tapered sleeve 16 (in the shape of a glove finger) slipped over the stem 8 via the open end 17 of the sleeve. The free end 8*a* of the stem 8 includes an inclined surface which does not appear in the plane of the figure. A slit 10 in an axial plane has been made in the free end 16*a* of this glove finger. This free end 16*a* also includes an inclined surface (not visible in the figure) which matches the inclined surface of the stem 8. The solid part 80 which thus lies inside the tapered sleeve 16 has a reduced cross-section, such as to form an annular cylindrical space 19, serving as product reservoir, so as to enhance the autonomy of the dosing applicator. In the vicinity of the junction region 23 between the stem 8 and the sleeve 16, a vent hole 16*a* is provided, facilitating the filling of the space 19 with product.

Figure 12:
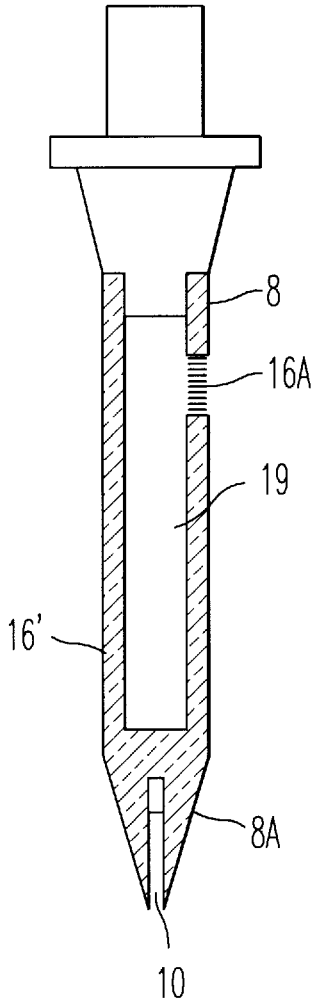

The stem 8 represented in FIG. 12 differs from that of FIG. 11 solely through the presence of a hollow sleeve 16' defining a large volume 19, the sleeve being provided, as in FIG. 11, with a vent or filling orifice 16*a*. The end 8*a* of the sleeve 16' is bevelled.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A capillary dosing applicator for applying a cosmetic product comprising:

a stem comprising a first end and a second end, said stem provided with a plane of symmetry;

a grip provided at the first end of the stem;

a substantially linear inclined surface provided on at least one part of an outer surface of said second end, wherein said inclined surface is substantially perpendicular to said plane of symmetry and inclined with respect to a longitudinal axis of said stem, and wherein said inclined surface terminates in a tip of the stem, said tip located at a point furthest from said first end of said stem; and at least a first slit provided at said second end of the stem and substantially aligned with said plane of the stem, said first slit opening along opposite sides of second end of the stem and terminating at said tip;

wherein at least a portion of at least one of said tip and stem is made of a flexible material.

2. A dosing applicator according to claim 1, wherein the second end of the stem has a cloven hoof shape.

3. A dosing applicator according to claim 1, wherein the second end of the stem is made from a cellular flexible material.

4. A dosing applicator according to claim 1, wherein the second end of the stem is provided with a flocking.

5. A dosing applicator according to claim 1, wherein the second end includes several slits.

6. A dosing applicator according to claim 1, wherein the second end of the stem includes several cross slits.

7. A dosing applicator according to claim 1, wherein the stem is hollow.

8. A dosing applicator according to claim 1, further comprising a damping system between the stem and the grip.

9. A dosing applicator according to claim 1, wherein the stem includes at least one groove emerging into the slit.

10. A dosing applicator according to claim 9, wherein the at least one groove is oriented parallel to the axis.

11. A dosing applicator according to claim 1, wherein the second end of the stem is cut on a slant.

12. A dosing applicator according to claim 1, wherein the second end of the stem is rounded.

13. A dosing applicator according to claim 1, further comprising at least a second slit which crosses said at least one slit, a height of one of the at least one slit and the second slit being greater that a height of the other of the at least one slit and the second slit.

14. An assembly comprising:

a container provided with a neck;

a grip able to close the container;

a dosing applicator;

wherein said dosing applicator comprises a stem comprising a first end and a second end, said stem provided with a plane of symmetry;

a grip provided at the first end of the stem;

a substantially linear inclined surface provided on at least one part of an outer surface of said second end, wherein said inclined surface is substantially perpendicular to said plane of symmetry and inclined with respect to a longitudinal axis of said stem, and wherein said inclined surface terminates in a tip of the stem, said tip located at a point furthest from said first end of said stem; and at least a first slit provided at said second end of the stem and substantially aligned with said plane of the stem, said first slit opening along opposite sides of second end of the stem, through said inclined surface and terminating at said tip wherein at least a portion of said applicator is made of a flexible material.

15. An assembly according to claim 14, further comprising a wiping element surrounding the stem and mounted on the neck of the container.

16. An assembly according to claim 14, wherein the second end of the stem has a cloven hoof shape.

17. An assembly according to claim 14, wherein said container contains a liquid care product.

18. An assembly according to claim 14, wherein said container contains a make-up product.

19. An assembly according to claim 16, wherein said container contains a liquid nail care product.

20. A capillary dosing applicator comprising, a stem comprising a first end, a second end and an outer surface, said stem provided with a plane of symmetry, said second end tapering to a tip at a point furthest from said first end;

a grip provided at the first end of the stem;

a substantially linear inclined surface provided on at least one part of said outer surface of said second end wherein said inclined surface is inclined with respect to a longitudinal axis of said stem and oblique with respect to said plane of symmetry, and wherein said inclined surface terminates in a tip of the stem, said tip located at a point furthest from said first end of said stem; and a slit provided at said second end of the stem and substantially aligned with said plane of the stem, said first slit opening along opposite sides of second end of the stem, and terminating at said tip.

* * * * *